US008291536B2

(12) United States Patent
Park et al.

(10) Patent No.: US 8,291,536 B2
(45) **Date of Patent: *Oct. 23, 2012**

(54) LAUNDRY MACHINE AND METHOD FOR CONTROLLING THE SAME

(75) Inventors: Seog Kyu Park, Changwon-si (KR); Park Kwang Cheol, Busan (KR)

(73) Assignee: LG Electronics Inc., Seoul (KR)

( * ) Notice: Subject to any disclaimer, the term of this patent is extended or adjusted under 35 U.S.C. 154(b) by 586 days.

This patent is subject to a terminal disclaimer.

(21) Appl. No.: 11/628,755

(22) PCT Filed: Mar. 22, 2006

(86) PCT No.: PCT/KR2006/001042

§ 371 (c)(1),
(2), (4) Date: Feb. 6, 2008

(87) PCT Pub. No.: WO2006/101345

PCT Pub. Date: Sep. 28, 2006

(65) Prior Publication Data

US 2008/0250819 A1 Oct. 16, 2008

(30) Foreign Application Priority Data

Mar. 25, 2005 (KR) ..... 10-2005-0025106
Aug. 25, 2005 (KR) ..... 10-2005-0078191
Sep. 7, 2005 (KR) ..... 10-2005-0083218
Sep. 7, 2005 (KR) ..... 10-2005-0083219

(51) Int. Cl.
*D06B 19/00* (2006.01)

(52) U.S. Cl. ..... 8/149.3; 68/12.02

(58) Field of Classification Search ..... 68/12.02, 68/12.04, 12.05, 5 R, 5 C; 8/149.3, 158, 8/159

See application file for complete search history.

(56) References Cited

U.S. PATENT DOCUMENTS 2,958,954 A * 11/1960 Longenecker ..... 34/527
5,602,958 A 2/1997 Vergnes
6,058,743 A * 5/2000 Fujii et al. ..... 68/12.18

(Continued)

FOREIGN PATENT DOCUMENTS

CN 1537995 10/2004

(Continued)

OTHER PUBLICATIONS

Translation of Dober et al. EP 1275767A1, Jan 2003.*

*Primary Examiner* — Michael Barr
*Assistant Examiner* — David Cormier
(74) *Attorney, Agent, or Firm* — McKenna Long & Aldridge LLP

(57) ABSTRACT

A laundry machine and a method for controlling the same are disclosed. A method for controlling a laundry machine includes steps of receiving a selected course selected by a user; and supplying the predetermined small amount of steam (a steam supply amount) into a drum in case that the selected course is a refresh course. Also, a laundry machine includes a course select part for a user selecting a course thereon; and a controller for controlling to supply the predetermined amount of steam (steam supply amount) in case that the selected course is a refresh course. An object of the present invention is to provide a laundry machine of which washing efficiency is improved and wash water and energy are economized. Another object of the present invention is to provide a laundry machine which can remove wrinkles of laundry more efficiently.

15 Claims, 8 Drawing Sheets

U.S. PATENT DOCUMENTS

| | | | | |
|---|---|---|---|---|
| 2001/0049846 | A1* | 12/2001 | Guzzi et al. | 8/158 |
| 2002/0133886 | A1 | 9/2002 | Severns et al. | |
| 2004/0187527 | A1 | 9/2004 | Kim et al. | |
| 2004/0255391 | A1 | 12/2004 | Kim et al. | |
| 2009/0139036 | A1* | 6/2009 | Park | 8/149.3 |

FOREIGN PATENT DOCUMENTS

| | | | |
|---|---|---|---|
| CN | 1580359 | A | 2/2005 |
| DE | 694 11 127 | | 11/1998 |
| EP | 1 275 767 | A1 | 1/2003 |
| EP | 1 469 120 | A1 | 10/2004 |
| EP | 1469120 | A1 | 10/2004 |
| EP | 10507028 | A1 | 2/2005 |
| EP | 1 544 345 | | 6/2005 |
| EP | 1605090 | A2 | 12/2005 |
| JP | 4-158896 | A | 6/1992 |
| JP | 5-126311 | A | 5/1993 |
| JP | 7198104 | | 8/1995 |
| JP | 2004-167131 | A1 | 6/2004 |
| JP | 2005-021633 | A | 1/2005 |
| JP | 2005-040580 | | 2/2005 |
| JP | 2005-058741 | A | 3/2005 |
| JP | 2005-245818 | | 9/2005 |
| KR | 10-1999-0021435 | A | 3/1999 |
| KR | 2004-0088884 | A1 | 10/2004 |
| KR | 2004-0102506 | A | 12/2004 |
| KR | 10-2005-0060566 | | 6/2005 |
| KR | 10-2005-0091295 | A | 9/2005 |
| SU | 1481303 | A1 | 5/1989 |

* cited by examiner

LAUNDRY MACHINE AND METHOD FOR CONTROLLING THE SAME

This application claims priority to International application No. PCT/KR2006/001042 filed on Mar. 22, 2006, Korean Application No. 10-2005-0025106 filed on Mar. 25, 2005, Korean Application No. 10-2005-0078191 filed on Aug. 25, 2005, Korean Application No. 10-2005-0083218 filed on Sep. 7, 2005, Korean Application No. 10-2005-0083219 filed on Sep. 7, 2005, all of which are incorporated by reference, as if fully set forth herein.

TECHNICAL FIELD

The present invention relates to a laundry machine and a method for controlling the same, and more particularly, to a laundry machine using steam and a method for controlling the same.

BACKGROUND ART

In general, a laundry machine includes a washing machine for washing laundries and a dryer for drying laundries. Also, a washing machine with a drying function is under development. The washing machine is classified into a pulsator type, a drum type and an agitator type washing machine. The drum type washing machine has a drum horizontally mounted thereon, and washes laundry using.

Referring to FIGS. 1 and 2, a drum type washing machine will be described as an embodiment of a conventional laundry machine.

The drum type washing machine includes a body 10, a tub 20 mounted within the body 10, a drum 30 rotatably mounted within the tub 20, a driving unit for driving the drum 30.

An opening 11 is formed in front of the body 10 for loading/unloading the laundry, and a door 40 is coupled to the opening 11 for opening/closing the opening 11.

A rim part 50 is provided at the inner circumference of the opening 11 for making airtight between the door 40 and the opening 11. The tub 20 is supported within the body 10 by a damper 21. A heater 60 is further provided within the tub 20 for heating wash water.

The driving unit includes a motor 71 to drive the drum 30, a belt 72 to transmit the driving force of motor 71 to the drum 30. Alternatively, the driving unit may employ a motor directly connected to the drum 30.

However, the conventional laundry machine may have several problems as follows.

First, the conventional laundry machine has a problem of large energy consumption, because unnecessarily much wash water is used in case of washing a small amount of the laundry and the laundry with light soil. Moreover, almost the washing time taken to wash the small amount of laundry and the laundry with light soil is almost the same as the washing time to wash the laundry with normal soil.

Second, washing performance may be more efficient when a soaking cycle is performed before washing. However, the soaking cycle has a problem of too much consumption of washing water. Thereby, a soaking cycle may be not operated often.

Third, in a conventional washing process, there is no additional cycle for sterilizing the laundry. Recently, a laundry machine having a sanitary function has been released, which can sterilize the laundry by using another heater for heating wash water. However, the sanitary function is not preferred, because wash water as well as energy is used for sterilizing the laundry too much.

Finally, a conventional dryer and a washing machine with a drying function may cause wrinkles on the dried laundry. Thus, there is inconvenience that the dried laundry should be ironed for smoothing out its wrinkles.

DISCLOSURE OF INVENTION

Technical Problem

An object of the present invention is to provide a laundry machine of which washing efficiency is improved and wash water and energy are economized.

Another object of the present invention is to provide a laundry machine which can remove wrinkles of laundry more efficiently.

Technical Solution

To achieve these objects and other advantages and in accordance with the purpose of the invention, as embodied and broadly described herein, a method for controlling a laundry machine including steps of: receiving a selected course selected by a user; and supplying the predetermined small amount of steam (a steam supply amount) into a drum in case that the selected course is a refresh course.

The steam supply amount is determined based on the amount of laundry loaded into the drum (a laundry amount). The laundry amount is at least one of a sensed laundry amount sensed automatically by a sensor and an inputted laundry amount inputted by the user.

A step of altering the user is further included, where the user is alerted in case that the laundry amount is larger than a maximum laundry amount.

The more steam is supplied into the drum, the larger laundry amount is loaded. The steam supply amount is determined by a predetermined target drum temperature. The target drum temperature is between 40° C. and 60° C.

The target drum temperature is 45° C. in case that the laundry amount is relatively large. The target drum temperature is 40° C. in case that the laundry amount is relatively small.

A step of treating wash water is further included, where wash water within the drum is treated in case that the inputted course is a refresh course.

The step of treating wash water includes steps of sensing the wash water of drum, and discharging the wash water of drum to an outside if the amount of sensed wash water is more than a predetermined value.

The drum is rotated for a predetermined target drum rotation time in the step of supplying steam. The drum is rotated in a clockwise/counter-clockwise direction.

A step of rotating a drum is further included, where the drum is rotated for a predetermined time period after the step of supplying steam.

The drum is rotated at a low speed and/or a high speed in the step of rotating a drum. The drum is rotated in a clockwise/counter-clockwise direction in the step of rotating a drum. The drum rotation time is determined based on the laundry amount loaded into the drum.

The laundry amount is re-determined at the time when the step of rotating a drum starts.

In another aspect of the present invention, a laundry machine includes: a course select part for a user selecting a course thereon; and a controller for controlling to supply the predetermined amount of steam (steam supply amount) in case that the selected course is a refresh course.

The controller controls a steam supply amount based on the laundry amount loaded into the drum. A temperature sensor is further includes for sensing a drum temperature to control the steam supply amount.

The drum is rotated in a clockwise/counter-clockwise direction.

A laundry amount select part is further includes for allowing a user to select the laundry amount thereon.

Advantageous Effects

The present invention has an advantageous effect that wash water as well as energy may be economized and that the laundry with a little soil may be washed efficiently, for example, soil, wrinkles and smell of the laundry is removed, the laundry is sterilized and static electricity of the laundry maybe prevented.

Furthermore, the present invention has another advantageous effect that wrinkles caused in dried laundry and keeping the laundry may be removed without extra ironing.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Reference will now be made in detail to the preferred embodiments of the present invention, examples of which are illustrated in the accompanying drawings. This embodiment presents a drum type laundry machine as an example of a laundry machine according to the present invention.

Figure 1:
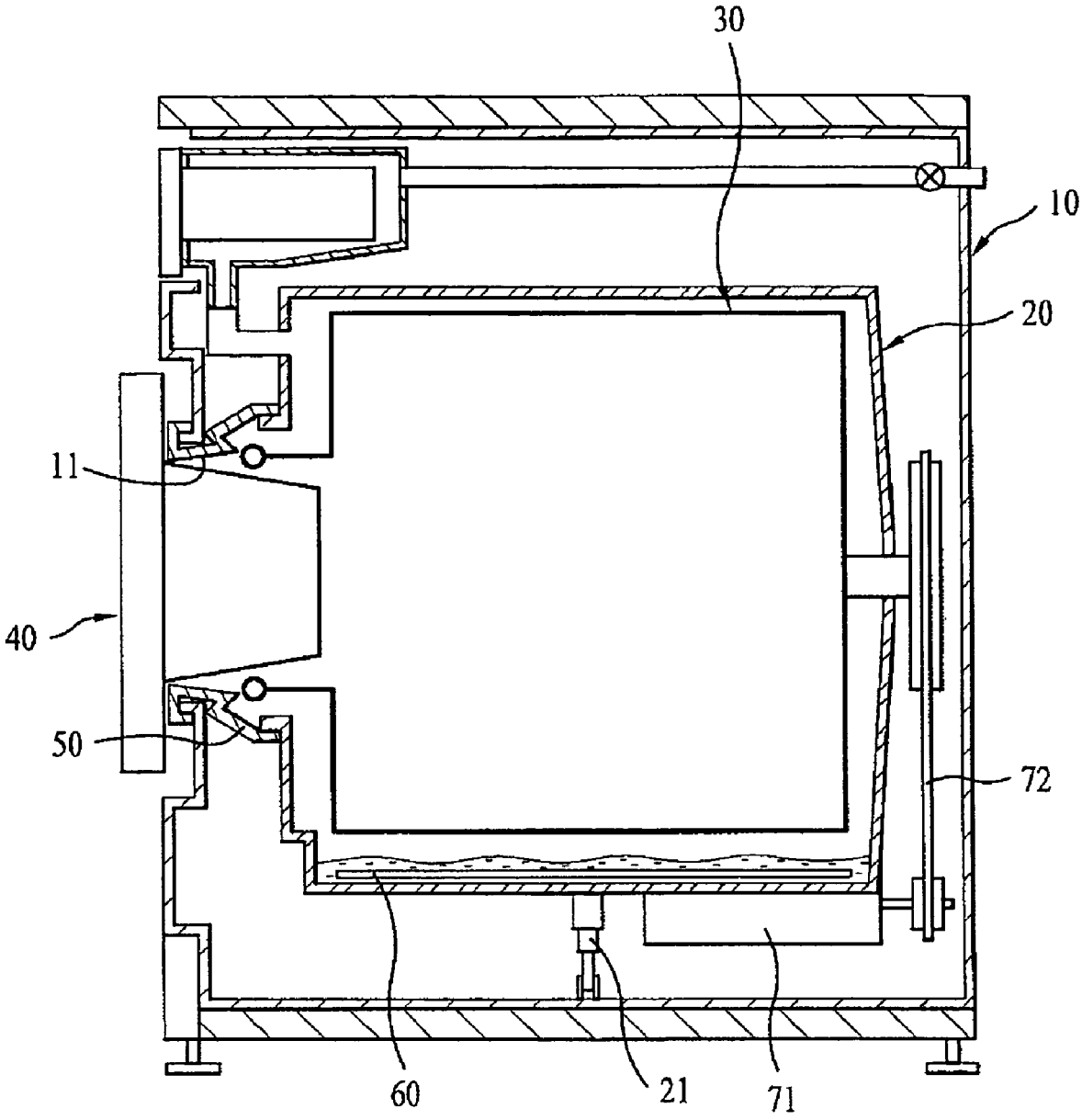
FIGS. 1 and 2 are sectional views illustrating a related art drum type washing machine.
Figure 2:
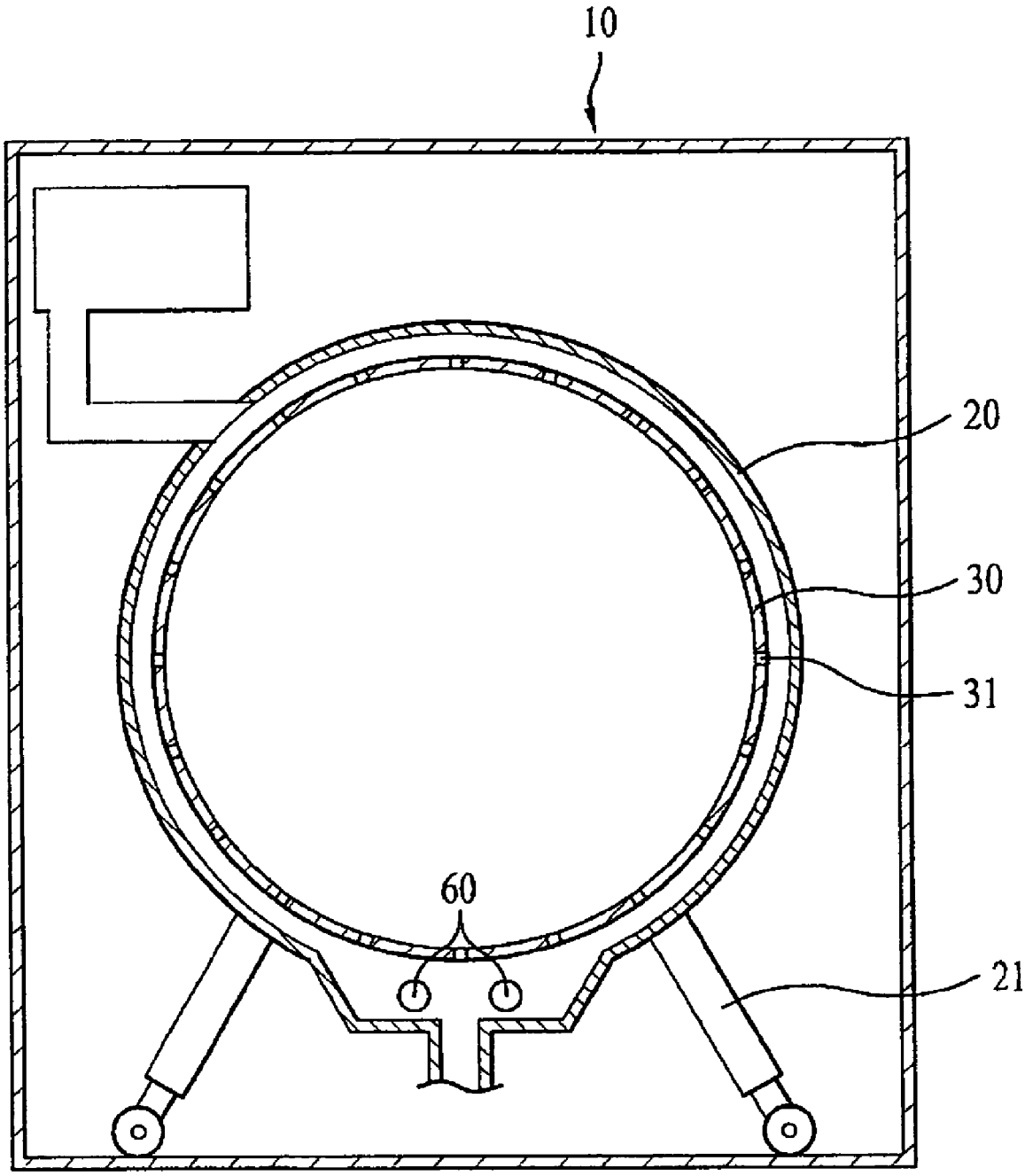
Figure 3:
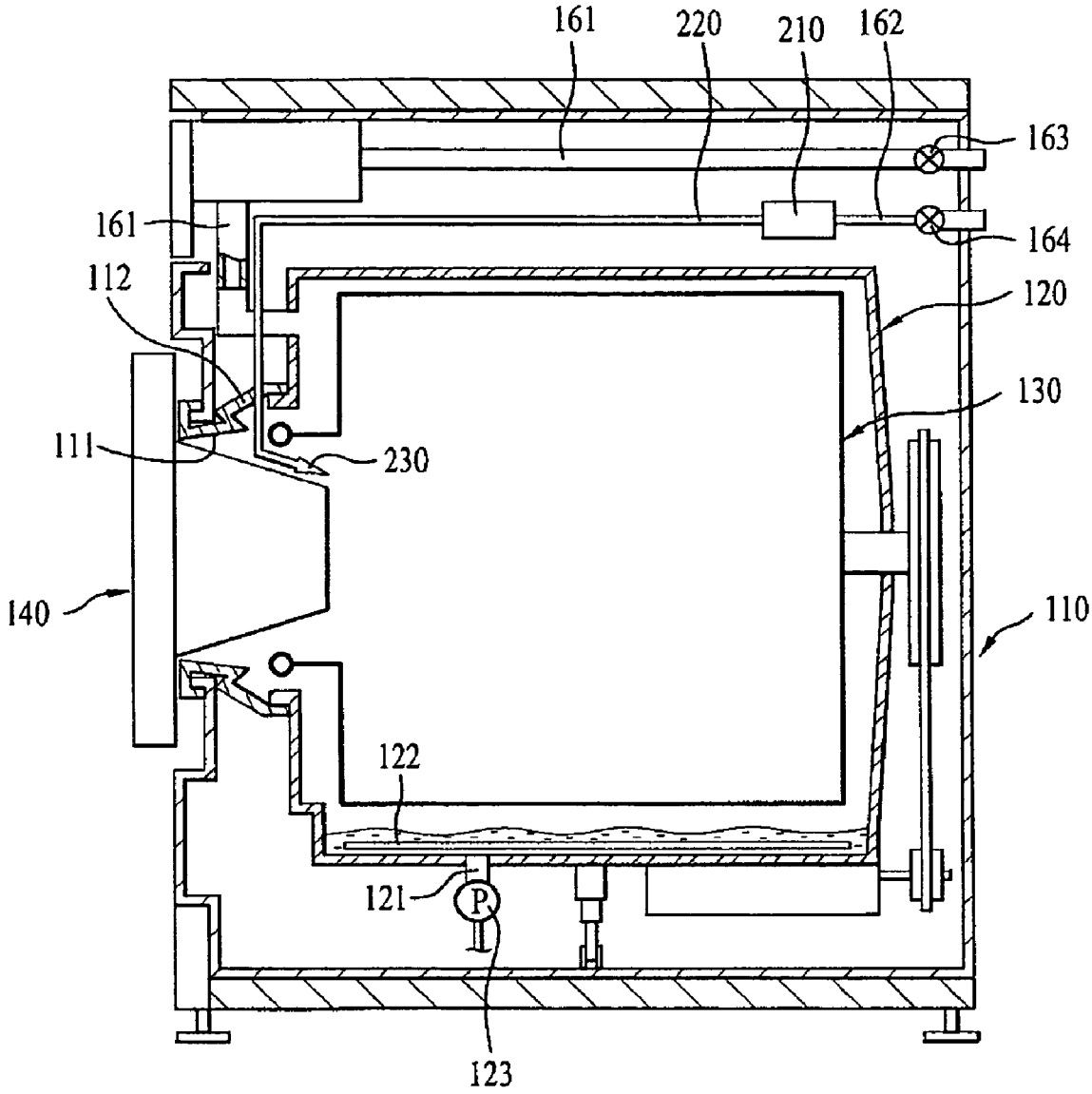
FIG. 3 is a sectional view schematically illustrating an embodiment of a laundry machine according to the present invention.
Figure 4:
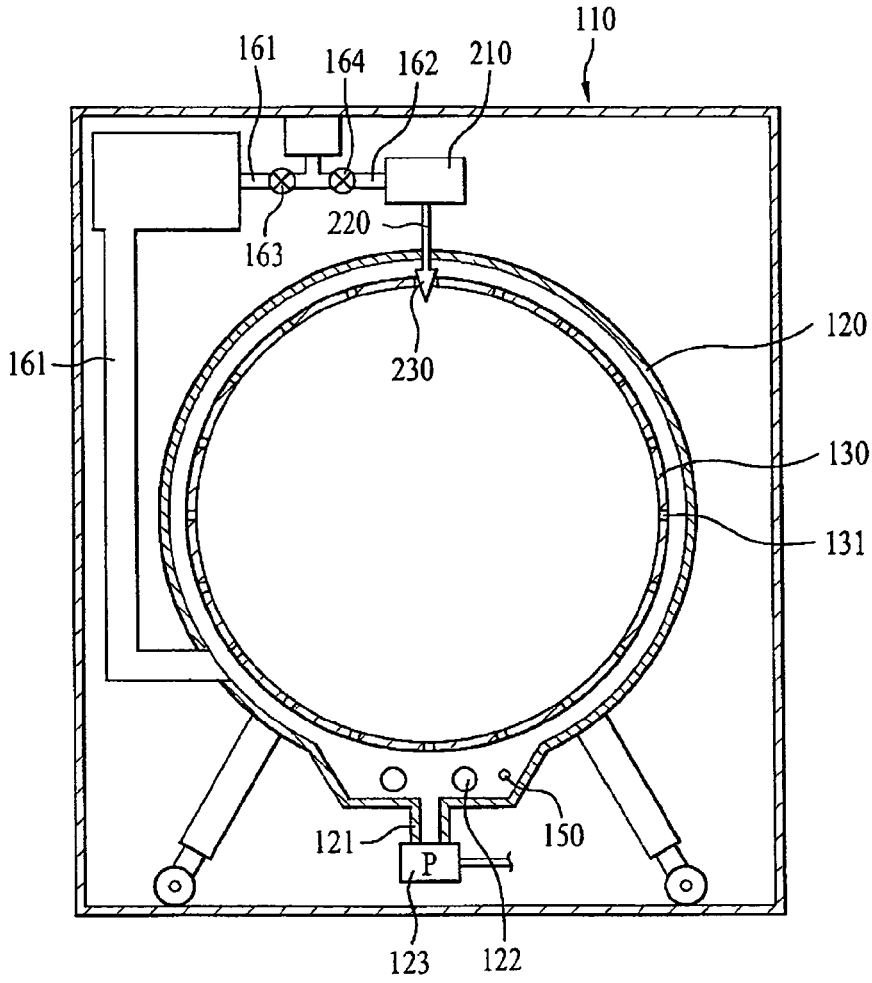
FIG. 4 is a sectional view illustrating the embodiment of laundry machine according to the present invention.

Referring to FIGS. 3 and 4, a drum type laundry machine according the embodiment, as similar to the related art, includes a body 110, a tub 120, a drum 130 and a temperature sensor 150. According the present invention, a steam supplying part is further included for generating and supplying steam into the drum 130 and/or the tub 120 (it will be described in detail later).

The body 110 defines an exterior of a drum type laundry machine and has an opening 111 in front thereof. A door 140 is coupled to the opening 111 of the body 110 for opening/closing the opening 111. A rim part 112 is provided for making airtight between the door 140 and the opening 111. The tub 120 is supported within the body 110 by a damper. A wash water supply pipe 161 is provided in the body 110 for supplying washing water into the tub 120. A water drain path 121 is connected with the lower end of tub 120 for draining wash water. A water drain pump 123 is provided at the water drain path 121 for forcibly draining wash water. Furthermore, a wash water heater 122 is provided in the tub 120 for heating washing water of the tub 120.

The drum 130 is rotatably mounted within the tub 120 and has a plurality of through holes formed on the circumferential surface of the drum 130 for drawing wash water between the tub 120 and the drum 130.

The steam supplying part according to the present invention will be described as follows.

The steam supplying part supplies steam into the tub 120 and/or the drum 130 (hereinafter, referred to as drum on convenience sake), and one or more steam supplying parts may be provided.

The steam supplying part includes a heating part 210 for generating steam, a steam supply pipe 220 for supplying generated steam to the drum 130 and a water supply pipe 162 for supplying water into the heating part 210. Preferably, an injecting part 230 is further provided at the front end of steam supply pipe 220 for injecting steam into the drum 130. It is preferred but not necessary that the injecting part 230 is formed as a nozzle and that the front end of injecting part 230 passes through the rim part 112 to be directed toward the inside of drum 130.

The temperature sensor 150 senses the temperature of tub 120 (hereinafter, a tub temperature), and preferably is provided in a lower portion of the tub 120, that is, the position where the wash water heater 122 is provided. The temperature sensed by the temperature sensor 150 is used to control the operation of steam supplying part. Reference numbers 163 and 164 are valves for opening/closing washing water supply pipes 161 and 162.

Figure 5:
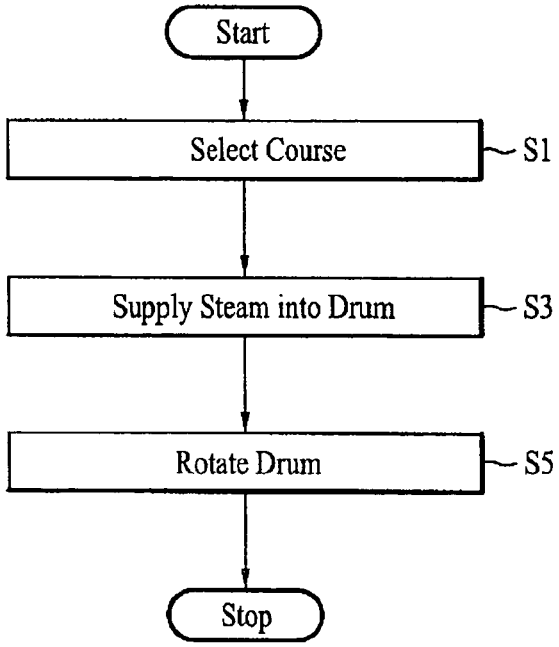
FIG. 5 is a flow chart illustrating a basic concept of a method for controlling the laundry machine according to the present invention.
Figure 6:
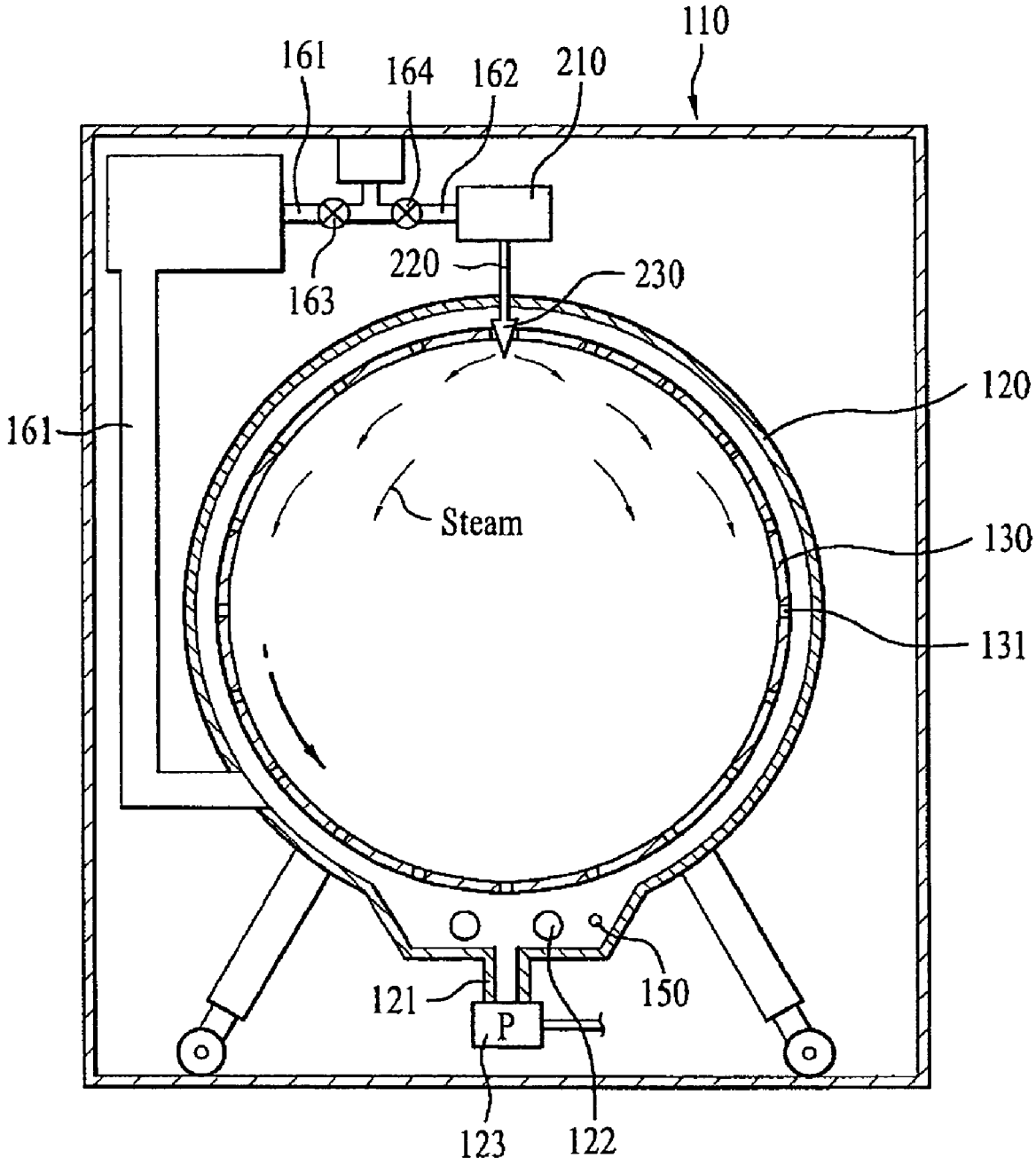
FIGS. 6 and 7 are sectional views illustrating operations of the laundry machine according to the present invention.
Figure 7:
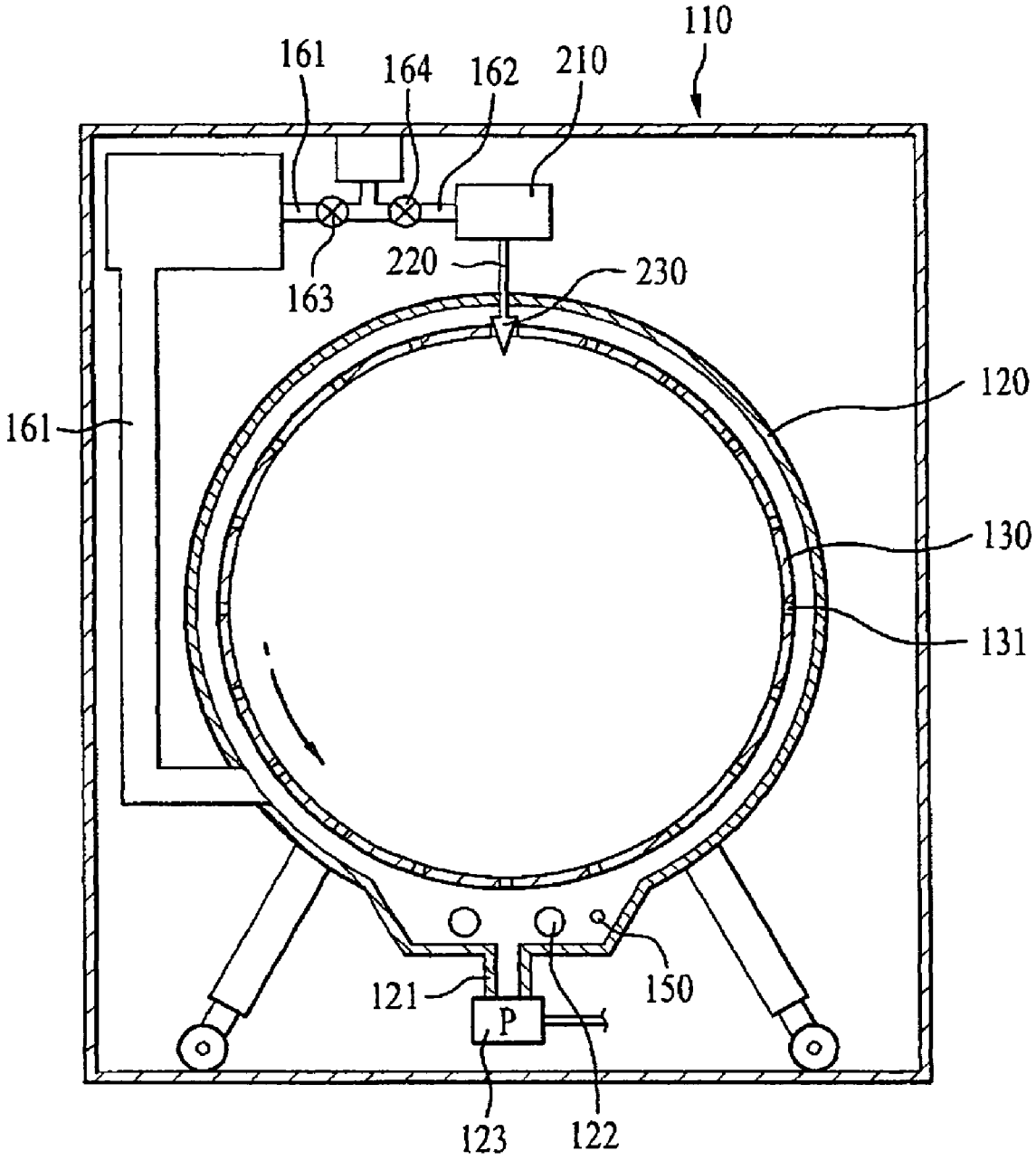

Referring to FIGS. 5 to 7, the laundry machine and a method for controlling the laundry machine according to the present invention will be described as follows.

When using the laundry machine, a user may select courses which he/she wishes to (S1). Generally, the courses may include a standard, a kind of fabric, a tub/drum wash and a sanitary course. The present invention further includes a course for freshening up the laundry (hereinafter, a refresh course). In the refresh course, steam is supplied to the laundry. According as studied by the inventor, wrinkles of the laundry may be smoothed out in the refresh course, and also smell thereof may be removed, thereby resulting in advantageous effects of sterilization as well as antistatic electricity. Steam is used for the laundry to contain a small amount of moisture, such that wrinkles of the laundry may be smoothed out. Especially, since the temperature of steam is high, wrinkles can be removed more efficiently. Dried laundry and dehydrated laundry, which contains a small amount of moisture after spinning, can be freshened up in a refresh course.

As shown in FIG. 6, if the user selects a refresh course, steam is supplied into the drum (S3). In the steam supply step, the amount of steam supply is determined based on a predetermined criterion. Preferably, the drum is rotated in the steam supply step.

As shown in FIG. 7, once steam is supplied, it is preferred that the drum is rotated for a predetermined time period (hereinafter, a drum rotating time) in a state where steam is not supplied (S5). In the drum rotating step, the drum rotation time is determined based on predetermined criteria Hence, the drum is rotated during the determined time period.

Figure 8:
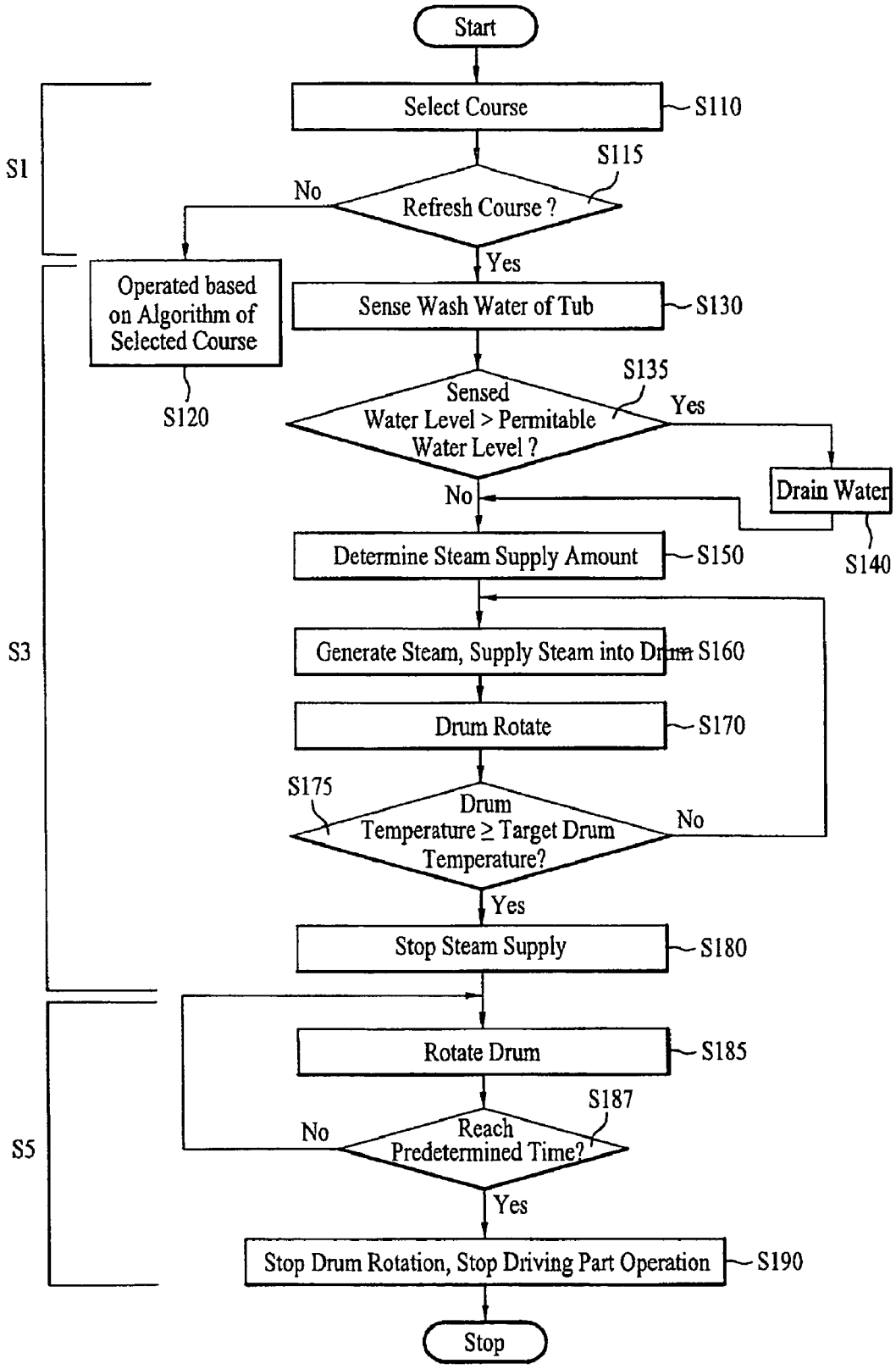
FIG. 8 is a flow chart illustrating an embodiment of the method for controlling the laundry machine according to the present invention.

Referring to FIG. 8, a preferred embodiment of a method for controlling the laundry machine according to the present invention will be described in detail.

The basic concept of present invention is specifically applied to the embodiment. Although a course select step (S1), a steam supply step (S3) and a drum rotate step (S5) are classified to include several sub-steps in FIG. 8, they are illustrated to make easier to understand the basic concept of the present invention. In another point of view, the classification of the S1, S3 and S5 may be varied.

A controller (not shown) of the laundry machine receives a signal of a course selected by the user (S10). The controller checks whether the selected course is a refresh course (S115).

In case that the selected course is not a refresh course, a corresponding course is performed based on algorithm predetermined in accordance with each course (S120). Whereas, in case that the selected course is the refresh course, the steps (S150~S180) of supplying steam are performed. Preferably, the steps of treating wash water (S130~S150), performed in predetermined ways, are performed before starting the steps of supplying steam. In the steps of treating wash water, wash water within the drum which might remain therein is discharged outside. The reasons why wash water should be discharged are following. The refresh course uses steam in stead of wash water to remove wrinkles of the laundry as well as smell thereof. But, if wash water should remain within the drum in the refresh course, the laundry within the drum might be dampened due to the remaining wash water. In addition, since the temperature sensor 150 is provided in the lower portion of tub 120, the temperature sensor 150 is sunk under wash water, such that the drum temperature cannot be sensed precisely (the function of temperature sensor will be described later). Accordingly, it is preferred that wash water within the drum, if remains, should be treated in the operation of refresh course. Also, preferably a maximum level of wash water within the tub 120 is a water level high enough not to touch the temperature sensor 150.

The steps of treating wash water will be described in detail.

First, the wash water level of tub 120 is sensed via a water level sensor (not shown) (S130). If the sensed water level is higher than a permitable maximum level (S135), wash water is drained outside (S140).

If the wash water level is the same as the height of temperature sensor or as similar as that, wash water may touch the temperature sensor due to vibration generated in the operation of a drum type laundry machine. Thereby, the temperature may not be sensed or may be sensed into wrong values. Thus, the permitable maximum water level should be lower than the temperature sensor 150 at least. Preferably, the permitable water level is a zero water level or under the zero water level. The zero water level may be defined as a water level of a state where wash water within the drum is completely discharged. Of course, even in the state of zero water level, wash water within the tub 120 might remain. However, the remaining wash water is much enough not to affect the operation of temperature sensor 150.

As mentioned above, once wash water within the drum 130 is drained enough under the permitable wash water level, the steam supplying part is controlled to generate steam and the steam is supplied into the drum 130. An example for generating and supplying steam is following. The controller controls each water supply valve 163 and 164 to supply wash water only to the steam supplying part, not to the tub 120. Water supplied to the steam supplying part is heated into steam to be supplied into the drum 130. Generating steam and supplying it into the drum may be embodied in several ways. Thereby, specific description will be omitted.

Meanwhile, preferably, when steam is supplied into the drum 130, the drum 130 is rotated, because the laundry may be prevented from getting tangled by rotating the drum 130 as well as the steam may be supplied to the laundry uniformly. For enhancing the effect of anti-tangling the laundry, it is preferred but not necessary that the drum is rotated in a clockwise/counter-clockwise direction. Also, the drum 130 may be rotated repeatedly or periodically. The rotation speed of the drum 130 is not limited. That is, it is possible to combine the low speed and the high speed of drum rotation, but preferably the rotation speed of drum 130 is a tumbling speed. The laundry is not attached to the inner surface of the drum 130 at the tumbling speed.

There may be several ways of determining the amount of steam supplied in the steps of supplying steam. For example, steam may be supplied into the drum for a predetermined time period. If steam is supplied into the drum for a long time, the laundry may be dampened by a large amount of steam. It is not preferred to dampen the laundry in a refresh course. The higher the drum temperature may be, the more efficiently refreshing function may be improved. But, in case that the drum temperature is too high, problems may be caused such as fabric damage or fabric deformation. Consequently, the amount of steam supply should be determined to prevent fabric damage as well as perform good refreshing efficiency.

According as studied by the inventor, it is very efficient to control the steam amount by using the drum temperature instead of steam supplying time. In other words, the inventor was motivated and perceived that there is correlation between the steam supplying time and the drum temperature. According to the present invention, the drum temperature increases as steam is supplied. Hence, the drum temperature is sensed and the sensed drum temperature is controlled not to increase more than a predetermined target temperature, thereby controlling the steam amount. Hereby, since the drum temperature is used as a control factor, the refreshing function may be performed simply as well as efficiently.

The target drum temperature determining the amount of steam supply could be determined in various ways. Preferably, when steam is supplied into the drum until the drum temperature reaches 40° C.~60° C., preferably 45° C., fabric damage may be prevented with good refreshing function. It is determined whether the sensed drum temperature reaches the target temperature (S175). Hence, when the sensed drum temperature reaches the target temperature, the steam supplying part is controlled to stop supplying steam into the drum (S180).

Meanwhile, the wash water level of the tub 120 may increase due to the steam supplied into the drum 130. Thus, it is preferred to treat the wash water of tub 120 in a process of supplying steam into the drum 130. That is, when the sensed wash water during the refresh course reaches a permitable water level, it is preferred to drain the wash water. At that time, the operation of steam supply part may be stopped.

Preferably, the drum 130 is rotated for a predetermined time period in a state where steam supplying is stopped. Also, preferably, the drum 130 is rotated in a clockwise/counter-clockwise direction. Also, the drum 130 may be rotated repeatedly or periodically. The rotation speed is not limited. That is, is it possible to combine a low speed of rotation and a high speed of rotation appropriately, but preferably the drum is rotated at a low speed, for example, a tumbling speed where the laundry is not attached to the inner wall of drum by centrifugal force.

The drum rotation time may be determined based on the amount of laundry loaded into the drum. For example, if the laundries are approximately 5 pieces, the drum rotation time may be set for 10 minutes.

Preferably, the drum rotation time is predetermined before a refresh course starts, that is, before steam is supplied into the drum. The predetermined drum rotation time is memorized at the controller. Also, preferably the actual drum rotation time is counted after the drum temperature reaches the predetermined temperature. In other words, once the drum temperature reaches the predetermined drum temperature, actual drum rotation time is counted as only the drum 130 is rotated. When the actual drum rotation time reaches the predetermined drum rotation, the rotation of drum 130 is stopped and the operations of the other driving part (S190).

Figure 9:
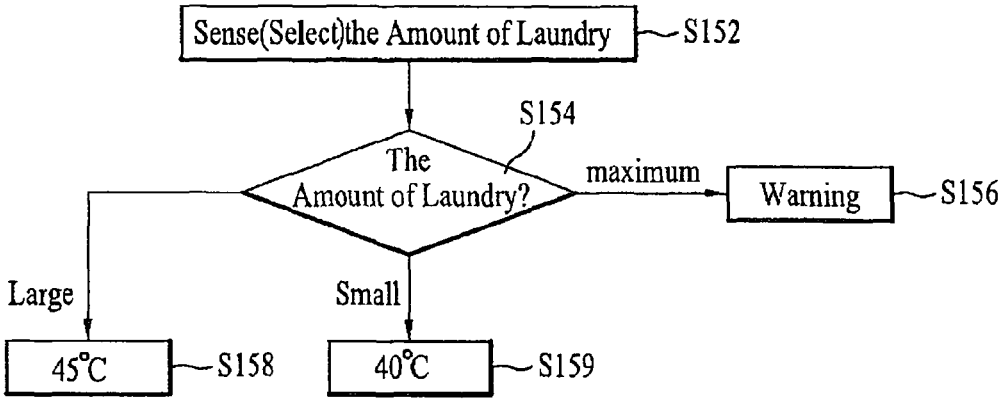
FIG. 9 is a flow chart illustrating another embodiment of the method for controlling the laundry machine according to the present invention.

Referring to FIG. 9, another embodiment of the present invention will be described.

This embodiment is the same as the embodiment described above in view of a basic concept. But, according to another embodiment, it will be described more specifically how a target drum temperature is set based on the amount of laundry loaded into a drum.

Once the laundry is loaded, the amount of laundry (hereinafter, a laundry amount) is sensed (S152). Sensing the laundry amount may be performed in well-known methods used in a conventional laundry machine. For example, the laundry amount may be measured by the time when the rotation speed of motor reaches the predetermined rotation speed, and also it may be measured by the speed of motor rotation for a predetermined time period.

Meanwhile, the sensed laundry amount is pre-classified based on an appropriate criterion, for example, a large and a small. Thereby, the target drum temperature is determined (S154). Herewith, it is not easy to perfectly define the large and small, which are classification criteria of sensed laundry amount, because their values are variable according to the capacity of each laundry machine and the type of each laundry machine. Thus, the definition of the large and small could be determined through experiments according to a laundry machine, and preferably the determination criterion for judging the determined large and small is memorized in the controller in advance.

A target drum temperature is set based on the sensed laundry amount (S158 and S159). In case that the laundry amount is large, a relatively large amount of steam is supplied into the drum. In case that the laundry amount is small, a relatively small amount of steam is supplied into the drum. Thus, in case of a large amount laundry, the target drum temperature is set relatively high. In case of a small amount laundry, the target drum temperature is set relatively low. The more steam is supplied, the higher the drum temperature is getting. Thus, when the target drum temperature is low, a small amount of steam is supplied, because the drum temperature reaches the target drum temperature fast. Whereas, when the target drum temperature is high, a large amount of steam is supplied, because the drum temperature reaches the target drum temperature relatively slow.

According to this embodiment, if less than 3 pieces of laundries are loaded into the drum, the laundry amount is classified as small, and if more than 4 pieces of laundries are loaded into the drum, the laundry amount is classified as large. In case that the sensed laundry amount is large, the target drum temperature is set at 45° C. In case that the sensed laundry amount is small, the target drum temperature is set at 40° C. Preferably, in this case, the laundries are shirts such as dress shirts which are delicate to wrinkles. But it is not limited as shirts, and other kinds of clothe items such as pants which are delicate to wrinkles may be freshened up in a refresh course. The laundry amount could be classified based on a different criterion. For example, in this case, the number of pieces for a small amount may be less than 3 pieces due to the different capacity of laundry machine.

Meanwhile, the maximum laundry amount may be set according to a kind of a laundry machine. Thus, it is determined whether the sensed laundry amount is more than the maximum laundry amount (S154). Hence, if the sensed laundry amount is more than the maximum laundry amount, it is preferred to alert the user. The method for alerting the user may be embodied in several ways, for example, sound messages such as a beep sound and a warning alarm or visual messages such as a display on/off.

It is possible to automatically sense the laundry amount by using a sensor, and the user may also select the laundry amount directly. In case that the user selects the laundry amount directly, preferably a laundry amount select part (not shown) is provided at a control panel (not shown) for operating the laundry machine. The laundry amount select part may be a button.

The methods in which the user selects the laundry amount directly may be presented in several ways. For example, the user may input the number of the laundry loaded into the drum and/or the type of the laundry. Alternatively, the user may input a large or a small of laundry amount. At that time, since the large or the small of laundry amount may have various values according to each capacity and each model of laundry machines, it should be predetermined in appropriate ways. For example, when the laundries are 1~3 pieces, the laundry amount is set as a small. When the laundries are 4~5 pieces, the laundry amount is set as a large. It is preferable that the criteria for the laundry amount is determined based on the number and the type of laundry.

If the user inputs the number of loaded laundry, the criterion for a small and a large laundry amount corresponding to the number of the laundry should be predetermined at a controller. Thereby, the laundry machine is controlled for a large and a small.

Figure 10:
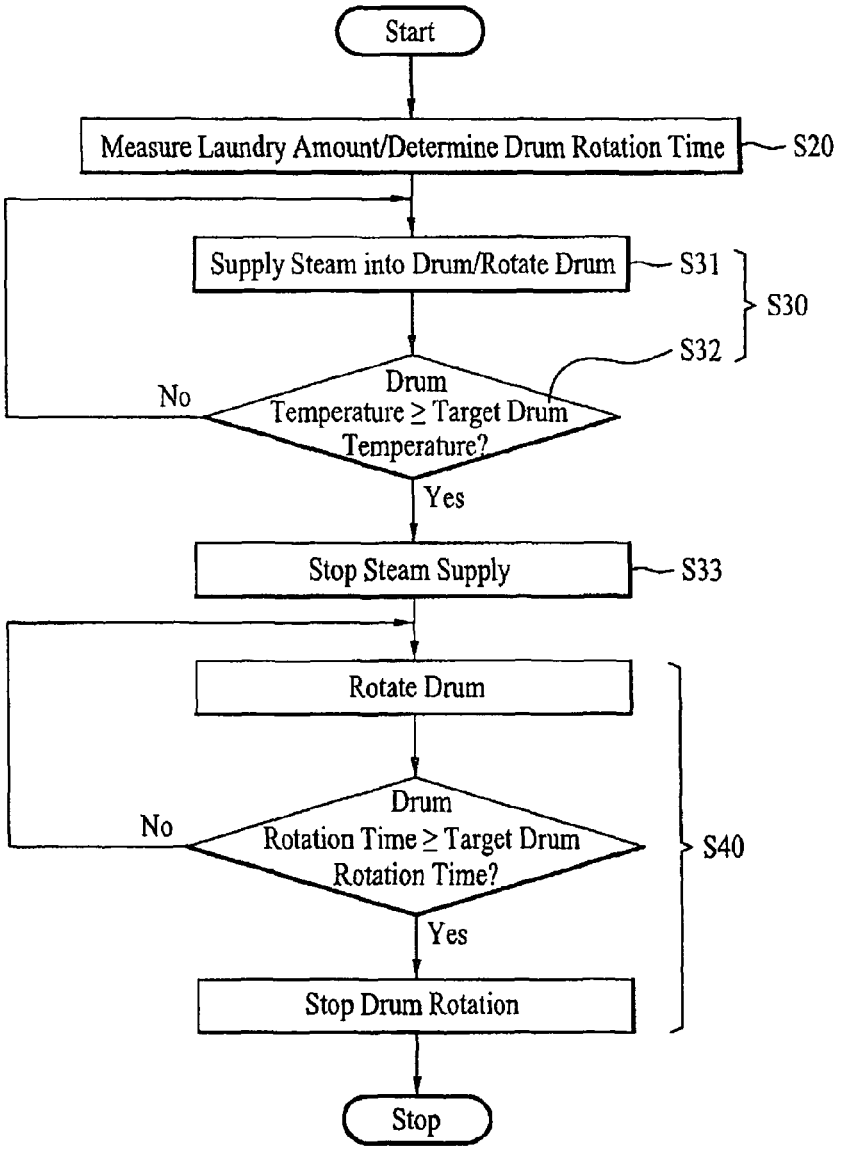
FIG. 10 is a flow chart illustrating a third embodiment of the method for controlling the laundry machine according to the present invention.

Referring to FIG. 10, a third embodiment of the present invention will be described.

This embodiment is also the same as the embodiment described above in its basic concept. That is, according to this embodiment, if a refresh course is selected, the steps of supplying steam (S20~S33) and the steps of rotating a drum (S40) are performed. But it will be described more specifically in this embodiment that a drum rotation time is set in the step of rotating a drum (S40).

Once the laundry is loaded into a drum, a controller senses the laundry amount, and a target drum rotation time without supplying steam is determined based on the laundry amount. That is, if the laundry amount is large, the drum rotation time is set long enough to remove wrinkles. If the laundry amount is small, the drum rotation time is set relatively short. Preferably, the target drum rotation time based on the laundry amount is pre-memorized at the controller (not shown).

According to the embodiments, the laundry amount is measured, and the drum rotation time is set right after the laundry is loaded into the drum. However, alternatively the laundry amount is measured and the drum rotation time is set at the moment when supplying steam into the drum is stopped and the drum starts to rotate.

The present invention described above can be applied to a laundry machine using steam. Moreover, it is preferable that the laundry machine of the present invention further may include a drying function and then combine a refresh course and the drying function.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Industrial Applicability

The laundry machine and the method for controlling the laundry machine according to the present invention described above have the following advantageous industrial applicability.

The present invention has an advantageous industrial applicability that wash water as well as energy may be economized and that the laundry with a little soil may be washed efficiently. For example, soil, wrinkles and smell of the laundry is removed. In addition, the laundry is sterilized and static electricity of the laundry maybe prevented.

Furthermore, the present invention has another advantageous industrial applicability that wrinkles caused in dried laundry and keeping the laundry may be removed without extra ironing.

The invention claimed is:

1. A method for controlling a laundry machine comprising steps of:

receiving a signal indicating a course which is selected by a user from a course select part;

determining that a refresh course to freshen up laundry has been selected from the signal; and after determining that the refresh course has been selected, determining an amount of laundry loaded into a tub or drum, setting a predetermined target temperature of the drum based on the determined amount of laundry loaded, and supplying an amount of steam into the tub or drum, wherein the steam amount is determined, by the predetermined target temperature of the drum, to supply the steam supply amount appropriate to freshen up the laundry.

2. The method for controlling a laundry machine of claim 1, wherein the laundry amount is determined by using at least one of a sensor that senses the laundry amount and an input device that is used to input the laundry amount by a user.

3. The method for controlling a laundry machine of claim 2, further comprises alerting a user when the laundry amount is larger than a maximum allowable laundry amount in the tub or drum.

4. The method for controlling a laundry machine of claim 1 wherein the more steam is supplied into the drum when the larger laundry amount is loaded.

5. The method for controlling a laundry machine of claim 1, wherein the target temperature is between about 40° C. and 60° C.

6. The method for controlling a laundry machine of claim 5, wherein the target temperature is about 45° C. when the laundry amount is determined as large.

7. The method for controlling a laundry machine of claim 5, wherein the target temperature is about 40° C. when the laundry amount is determined as small.

8. The method for controlling a laundry machine of claim 1, further comprising:

sensing the wash water of the tub or drum, and discharging the wash water outside of the tub or drum if the amount of sensed wash water is more than a predetermined value.

9. The method for controlling a laundry machine of claim 1, further comprises rotating the drum during steam being supplied to the drum.

10. The method for controlling a laundry machine of claim 9, further comprises rotating the drum in a clockwise or a counter-clockwise direction.

11. The method for controlling a laundry machine of claim 1, further comprises rotating the drum for a predetermined time period after steam has been supplied to the tub or drum.

12. The method for controlling a laundry machine of claim 11, further comprises rotating the drum at a speed, wherein the speed being at least one combination of a low speed and a high speed.

13. The method for controlling a laundry machine of claim 11, further comprises rotating the tub or drum in a clockwise or a counter-clockwise direction.

14. The method for controlling a laundry machine of claim 11, further comprises determining a tub or drum rotation time based on the laundry amount loaded into the drum.

15. The method for controlling a laundry machine of claim 14, further comprises re-determining the laundry amount at the time when the drum starts to rotate.

* * * * *